US005628443A

United States Patent [19]

Deutsch

[11] Patent Number: 5,628,443

[45] Date of Patent: May 13, 1997

[54] MODULAR PACK SYSTEM AND APPARATUS

[76] Inventor: William J. Deutsch, 1429 Zepol Rd., Apt. 210, Santa Fe, N.M. 87501

[21] Appl. No.: 113,208

[22] Filed: Aug. 30, 1993

[51] Int. Cl.[6] ..... A45F 3/04

[52] U.S. Cl. ..... 224/583; 224/645; 224/629; 224/665; 150/113; 190/110

[58] Field of Search ..... 224/153, 151, 224/202–212, 224, 225, 575, 581, 582, 583, 627–632, 645, 665; 150/113; 190/110; 220/23.6; 248/223.41, 223.51, 223.61, 224.61

[56] References Cited

U.S. PATENT DOCUMENTS

| | | | |
|---|---|---|---|
| 2,461,526 | 2/1949 | Cull et al. | 224/209 |
| 3,078,484 | 2/1963 | Briggs | 248/223.41 |
| 3,114,486 | 12/1963 | Flexman | 224/211 |
| 3,233,803 | 2/1966 | Gray | 224/211 |
| 3,749,294 | 7/1973 | Johnston | 224/907 |
| 3,902,640 | 9/1975 | Geiben | 224/153 |
| 3,915,189 | 10/1975 | Holbrook et al. | 248/223.41 |
| 4,082,208 | 4/1978 | Lane, Jr. | 224/209 |
| 4,287,997 | 9/1981 | Rolfe et al. | 220/23.6 |
| 4,307,826 | 12/1981 | Stewart | 224/211 |
| 4,366,922 | 1/1983 | Levine et al. | 248/224.61 |
| 4,424,841 | 1/1984 | Smith | 224/151 |
| 4,491,258 | 1/1985 | Jones | 224/210 |
| 4,545,414 | 10/1985 | Baum | 150/113 |
| 4,673,070 | 6/1987 | Ambal | 190/110 |
| 4,790,432 | 12/1988 | Rees | 248/223.41 |
| 4,813,542 | 3/1989 | Thompson et al. | 220/23.6 |
| 4,884,731 | 12/1989 | Sibley | 224/153 |
| 5,131,576 | 7/1992 | Turnipseed | 224/211 |
| 5,184,763 | 2/1993 | Blaisdell et al. | 224/583 |
| 5,321,904 | 6/1994 | Benson | 248/223.41 |
| 5,419,473 | 5/1995 | Lamar | 224/211 |

FOREIGN PATENT DOCUMENTS

| | | | |
|---|---|---|---|
| 297188 | 1/1989 | European Pat. Off. | 224/213 |
| 908399 | 4/1946 | France | 224/211 |
| 2662341 | 11/1991 | France | 224/211 |
| 3402077 | 8/1985 | Germany | 224/153 |
| 2183462 | 6/1987 | United Kingdom | 224/211 |
| 2223930 | 4/1990 | United Kingdom | 224/211 |

*Primary Examiner*—Henry J. Recla
*Assistant Examiner*—Gregory M. Vidovich
*Attorney, Agent, or Firm*—R. Reams Goodloe, Jr.

[57] ABSTRACT

A modular apparatus for storage and transport of goods, primarily for use as a backpack. A first container for holding goods is provided with a first cooperating engagement portion, and a base is provided with a second cooperating engagement portion; the first and second portions cooperate to provide meshing engagement to detachably connect the first container the base. A stop is included in at least one of the first or said second cooperating engagement portions to limit the downward travel of the first container relative to the base. Further containers can be added, where each of the further containers includes cooperating engagement portion for meshing engagement with a complementary cooperating engagement portion of the already mounted containers. Preferably, the first cooperative engagement portion is a T-shaped slot formed from a pair of complementary, mirror image L-shaped members, and the second cooperative engagement portion is a T-shaped bracket of size and shape complementary to the T-shaped slot. Containers may also be provided to house hot and cold goods, as well as odd shaped goods such a sleeping bags.

2 Claims, 3 Drawing Sheets

MODULAR PACK SYSTEM AND APPARATUS

TECHNICAL FIELD OF THE INVENTION

This invention relates to a novel modular pack system, useful for back and belt packs. More specifically, a rugged, interchangable pack system that features modules which can be mixed and matched to provide storage for selected goods is disclosed and claimed herein.

BACKGROUND

There have been many types of pack systems developed over the years, particularly as the use of back and belt packs has become more common in outdoor recreation. Although a number of such systems have featured methods of adding packages and containers, such systems have generally been unable to provide easy methods to secure selected additional packages to the basic pack. Thus, there is a continuing need for a system which minimizes the need to carry unnecessary packaging components, while providing a system to conveniently carry diverse types of goods.

There have been numerous attempts to remedy the problem of problem of providing adequate packaging components while minimizing on unnecessary weight of then unwanted packaging. Various solutions proposed in the patent literature which provide a system which may possess one or more features resembling some remote extent to those of the present invention include the devices described in the following U.S. Pat. No. 3,114,486, issued Dec. 17, 1963, to Flexman for PACK CARRIER; U.S. Pat. No. 3,233,803, issued Feb. 8, 1966, to Gray for COMBINED TAKEDOWN PACKBOARD AND EXPANSIBLE PACKSACK; U.S. Pat. No. 3,749,294, issued Jul. 31, 1973, to Johnston for FISHING ROD HOLDER; U.S. Pat. No. 4,082,208, issued Apr. 4, 1978, to Lane for MODULAR CHEST BACK PACK. Also, German Offenlegungsschrift No. DE 3402077 describes a system of cases having burl-like indentations which fit into each other to lock the cases together.

Flexman's device included a corset-like pack frame body, with load carrying attachments in the form of a plurality of strap-like loops; his device did not allow for easy attachment of large containers.

Gray showed a packboard which included releasable interlocking portions that allowed the packboard to be taken down and compacted. The device also allowed an expansible multipart backpack to be attached to the packboard for easy removal; however, his device did not include any modular independent packaging pack portions.

Johnston's device illustrated an attachment bracket which was slidably insertable in a receiving socket in a support plate, where the bracket was useful for holding a fishing rod in a desired position at the support plate when worn by a fisherman.

Lane provided a set of stackable hollow containers which could be affixed to a packboard via strap means; the containers included walls of heat insulative material so that hot and cold materials could be transported.

Langer provided a rucksack with interlocking cases, however, his system is basically a vertically stacking system which did not provide for adding on cases rearwardly or in piggy-back fashion, nor did it provide for the convenient use of a backboard. Consequently, there is a continuing need for an improved modular pack system which includes interchangeable containers.

SUMMARY OF THE INVENTION

I have developed a novel modular hard-pack system capable of very quick and simple configuration changes, thus permitting easy selection of limited contents, or, as desired in use, rapid changes to the configuration being carried. A base or backboard with shoulder straps provides the basic structure for the backpack version, and a belt with backplate provides the basic structure for the belt or "fanny pack" version. Modular containers having complementary engagement means to affix such containers to the base and to each other, results in a "piggy-back" mode of operation. The modular containers are readily interchangeable.

The apparatus includes (1) a first container for holding goods, with the container having a first cooperating engagement means, and (2) a base having a second cooperating engagement means for cooperating with said first cooperating engagement means to detachably connect the first container to the base. At least one of the first or second cooperating engagement means includes a stop means, wherein said stop means cooperates with the bottom portion of the complimentary engagement means, so as to limit the downward travel of the container relative to the base when the base is in a substantially vertical position. Further containers can be added, where each of the further containers includes cooperating engagement means for connection with complementary engagement means in the already mounted containers. Preferably, the first cooperative engagement means is a T-shaped slot formed from a pair of complementary and preferably mirror image L-shaped members, and the second cooperative engagement means is a T-shaped bracket of shape complementary to and sized to fit into the T-shaped slot. Where desired and with containers appropriately sized, multiple containers may be placed in a set of cooperative engagement members.

The pack system also includes a flexible base design for use with a waist belt or fanny pack. One novel and unique feature is the piggyback waist belt container design.

OBJECTS, FEATURES, AND ADVANTAGES OF THE INVENTION

It is a primary object of the present invention to provide a modularized hard-pack system having readily changeable configurations.

By providing the modular hard-pack system as described herein, pack components desired for a particular trip or purpose are less troublesome to select and configure. More importantly, with my pack system, a truly custom-built, fully integrated, and yet completely functional pack arrangement can in many cases be achieved in a single built-up pack assembly.

It is an important feature of the present invention that the modules are quickly and easily added to and removed from a built-up configuration.

It is also an important feature of the present invention that the modules inherently maintain separation of the contents of the backpack.

It is also an important feature of the present invention that the modules can be designed to permit modules to piggy-back on other modules.

It is also an important feature of the present invention that the modules can be constructed of waterproof materials to provide moisture protection for contents and to allow wet contents to be isolated from dry contents.

It is also an important feature of the present invention that the modules can include thermally insulated construction to permit thermal isolation within the backpack.

It is also an important feature of the present invention that the modules could be constructed so as to inherently provide floatation capability.

Additional objects, advantages, and novel features of the invention will be set forth in the detailed description of the invention which follows, or may become apparent to the reader from the appended claims and accompanying drawings, or may be learned by practice of the invention. The invention accordingly comprises a description of a superior modular pack system, and the apparatus which embodies that system, all as exemplified in the following detailed disclosure, and the scope of which will be indicated in the accompanying claims, and which may be realized and attained by means of the instrumentalities and combinations particularly pointed out in the appended claims, or by their equivalents.

BRIEF DESCRIPTION OF THE DRAWING

My invention may be more clearly understood by reference to the accompanying drawing, wherein.

Where appropriate, like features are designated throughout the drawing with like reference characters, without additional comment.

DESCRIPTION

Figure 1:
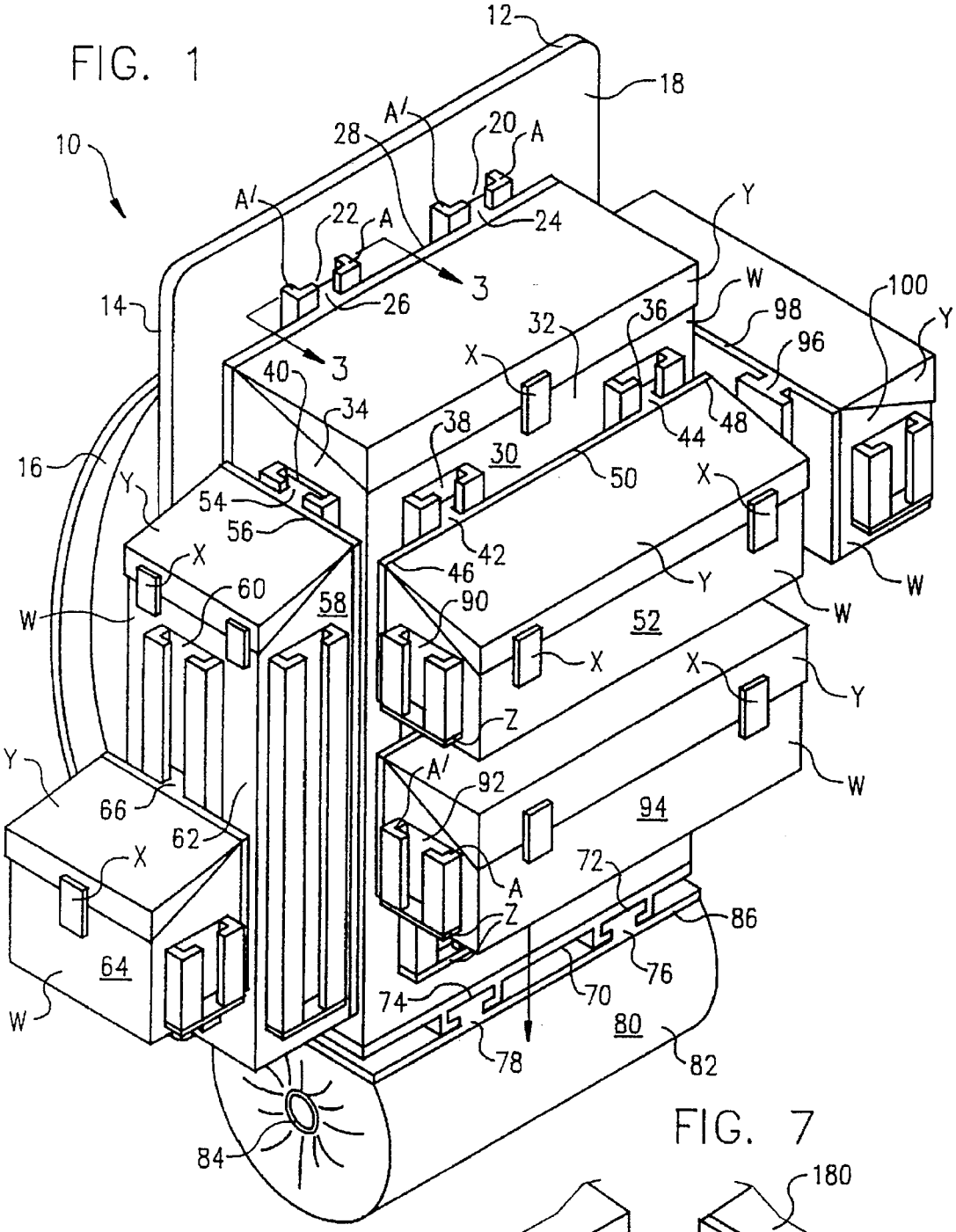
FIG. 1 is a perspective view of a backpack fully assembled with pre-selected interlocking containers, fabricated and assembled in accord with the teachings of the present invention.

Attention is directed to FIG. 1, wherein a perspective view of my modular backpack system 10 is shown. The system 10 consists of a base 12 having on a first or front side 14 a suitable attachment means such as the shoulder straps 16 (second strap illustrated in FIG. 2 below) for attachment to personnel (not shown) that carry the modular pack system 10. The base 12 includes, on the second side or rear 18, one or more female engaging means, such as the longitudinally extending T-shaped slots 20 and 22, which are suitable for receiving and detachably securing a complimentary male engaging means, such as T-shaped brackets 24 and 26 respectively that protrude from the rear 28 of a first container 30.

Figure 3:
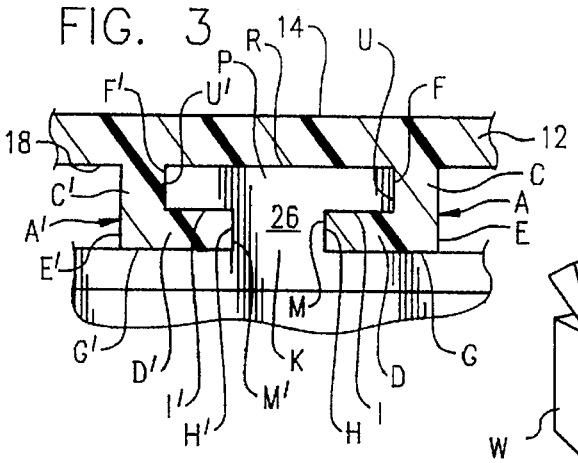
FIG. 3 is a top view looking downward on one embodiment of the interlocking system structure employed in the present invention, taken at section 3—3 of FIG. 1, and showing the T-shaped receiving and engaging slot in cross-section to reveal its complementary L-shaped members, and showing the T-shaped bracket from the top thereof.

The T-shaped slots 20 and 22 are each formed from a pair of complementary and preferably mirror image L-shaped members A and A'. As seen in FIG. 3, the L-shaped members A and A' are preferably integrally and seamlessly formed with their own base structure, which here is base 12. For convenience, it is sometimes advisable to provide the members A and A' and interconnecting backing (to make a "C" channel) as an integral add on structure to base 12. It will be appreciated by those knowledgeable in the art to which this specification is directed that the same basic result can be achieved, regardless of whether the L-shaped members are integrally provided or whether a separate C-shaped channel is provided, as the base 12 and L-shaped members A and A' form a C-shaped channel inherently.

In the embodiment illustrated, where the female engaging means is a T-shaped slot and includes L-shaped slot forming members A and A', the members A and A' are normally mirror images and include outwardly projecting limb portions C and C' and lip portions D and D'. The limb portions D and D' include outward walls E and E', respectively, and inward walls F and F', respectively. The lip portions D and D' include outward faces G and G', respectively, distal end portions H and H', respectively, and inward faces I and I', respectively.

The T-shaped bracket 26 includes a throat portion K and a ledge portion P connected thereto. The throat portion K has complementary sidewalls M and M'. The ledge portion P has a rear portion R, lateral edge portions U and U' and front edge portions X and X' The sidewalls M and M' of throat portion K are complementary in size and shape to distal end portions H and H' of lip portions D and D' of the L-shaped slot forming members A and A'. Likewise, the ledge portion P is shaped so that lateral edge portions U and U' are complimentary in size and shape to inward walls F and F' of limb portions D and D'.

Returning now to FIG. 1, it is seen that in modular fashion, the front 32 and left side 34 of the first container 30 are shown with additional engaging means comprising longitudinally extending T-shaped slots 36, 38, and 40. Slots 36 and 38 are suitable for receiving and securing complementary engaging means formed by T-shaped brackets 42 and 44, which are respectively located at the left 46 and right 48 rear 50 of a second container 52. The slot 40 at the left side 34 of first container 30 is adapted to receive T-shaped bracket 54 at rear 56 of third container 58. Also, this third container 58 has another longitudinally extending T-shaped slot 60 at its front 62, to provide a "piggyback" type option for adding additional fourth container 64, via use of further engaging means such as T-shaped bracket 66.

At the bottom 70 of the first container 30, engaging means such as T-shaped slots 72 and 74 are provided in a front to rear and relatively horizontal orientation. Slots 72 and 74 are configured to receive T-shaped brackets 76 and 78 respectively of a tubular and preferably substantially cylindrical container 80 adapted to receive goods such as a bedroll or sleeping bag (not shown). The container 80 includes an outer expansible covering 82 with expansible entrance 84. A base 86 is provided to seat the engaging members such as the T-shaped brackets 76 and 78 illustrated in a slidably engagable relationship with slots 72 and 74.

Attention is directed to the small container 52. Container 52 has a left side with a small vertically extending engaging means, specifically T-shaped slot 90. At the bottom of slot 90 is a stop Z. The stop Z is an important feature, as it keeps the various containers from sliding downward during use by engaging the bottom B (noted in FIGS. 2 and 3) of any complimentary T-shaped bracket. Similar slot 92 and stop Z features are shown on container 94, situated below container 52. Below container 94, stop Z is seen at the bottom of slot 38 on container 30.

At the right end 48 of container 52, a slot (not visible as illustrated) similar to slot 90 is provided to receive T-shaped bracket 96 located at the rear 98 of container 100. It is a unique advantage of my invention that container modules can be provided with pre-selected spacing wherein the female engaging means on desired first and second containers, here containers 30 and 52, can be interfitted with male engaging means, here T-shaped brackets 96 and 102 (shown in FIG. 2) on a third container, here container 100, to secure the desired and pre-selected third container 100 to the modular pack system 10.

Where desired, latches X can be provided for each container as a means to secure a lid portion Y to the main body W of the container.

Figure 2:
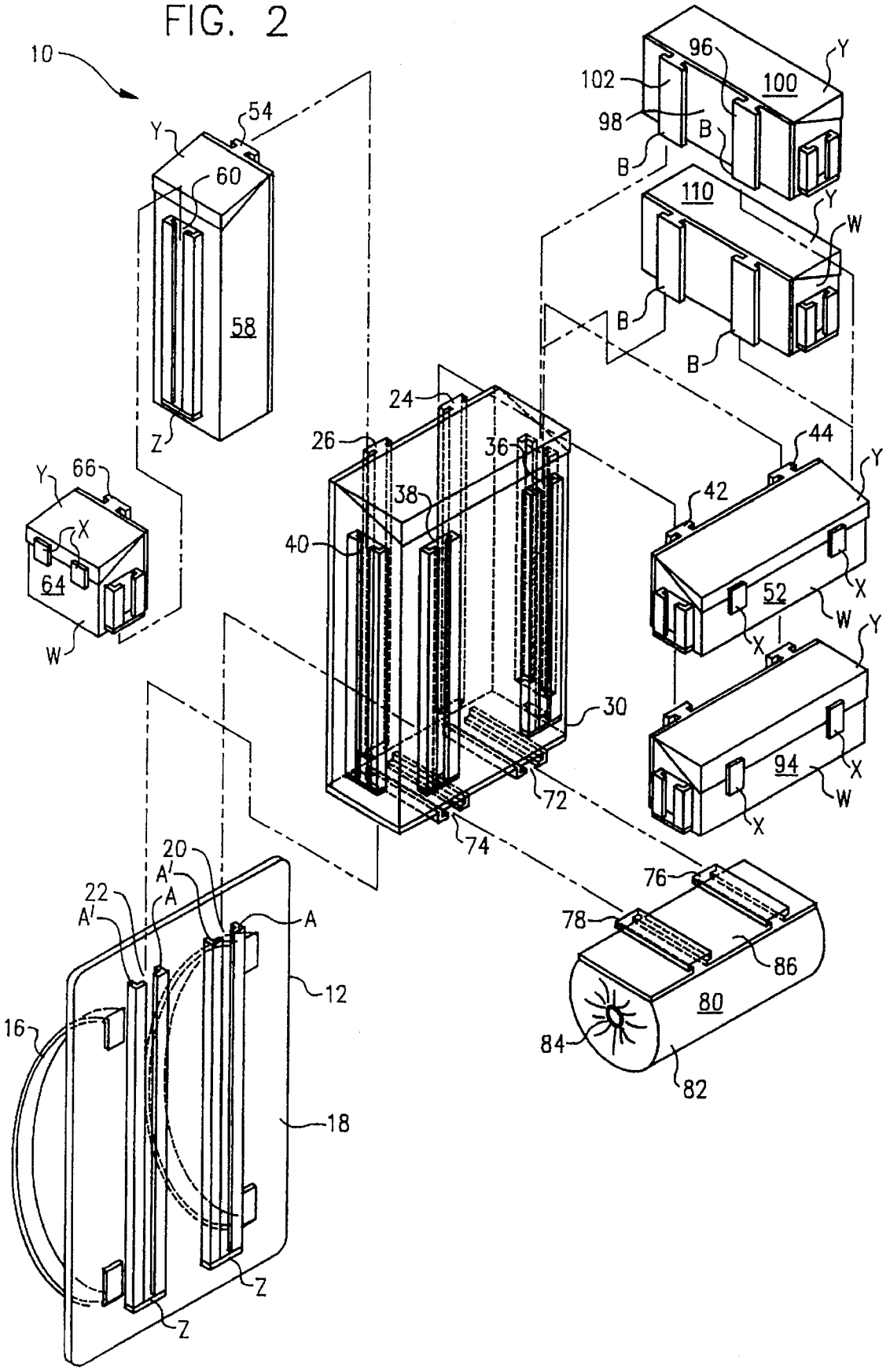
FIG. 2 is an exploded perspective view of the backpack and interlocking containers first set forth in FIG. 1 above.

Turning now to FIG. 2, an exploded perspective view is provided to further illustrate the detachably engaging components of my modular pack system 10. Although I prefer to use a substantially rigid base 12 fabricated of plastic like material, it could be constructed of any convenient rigid or semi-rigid material. The container 30 is also preferably provided in a substantially rigid material such as plastic that makes the spacing of further slots fairly reliable. Likewise, although I prefer the use of a substantially rigid plastic type rear portion for each container to use in fixing the location of T-shaped brackets thereto, other convenient construction materials are acceptable, so long as sufficient rigidity is provided to maintain the interlocking characteristics during use, as well as provide the desired light weight. However, it must be appreciated that the advantages of the present interlocking modular construction pack system can also be attained in substantial measure by non-rigid containers, so long as sufficient rigidity is provided in the various interlocking engagement means utilized.

In FIG. 2, it can be seen how container 30 is attached to pack base 12. The T-shaped brackets 24 and 26 at the rear 28 of container 30 fit into T-shaped slots 20 and 22, respectively, on board 12. The brackets 24 and 26 are free to slide downward in slots 20 and 22 until the bottom B of brackets 24 and 26 hit stops Z at the bottom of slots 20 and 22. Then, container 30 may be independently and singularly carried by base 12, or, if desired, additional containers may be added. If container 58 is desired, for example to provide an insulated container for maintaining a cool drink therein, bracket 54 may be slid down slot 40 until the bracket 54 of container 54 rests at stop Z at the bottom of slot 40. Similarly, bracket 66 of container 64 can be slid downward in slot 60 of container 58 until bracket 66 hits stop Z at the bottom of slot 60. The just described method generally applies to the addition of other containers to the containers already provided, and need not be described further. Also, it can be appreciated that the container 30 need not be used, and that other containers, for example containers 52 and 94, may be used directly by attachment to base 12. Likewise, it is not necessary to always use all containers, for example container 110, shown in the configuration illustrated in FIG. 2, is not provided in the configuration illustrated in FIG. 1; the stop Z on the right end 48 of container 52 being sufficient to maintain the selected vertical position of container 100, as shown.

Figure 4:
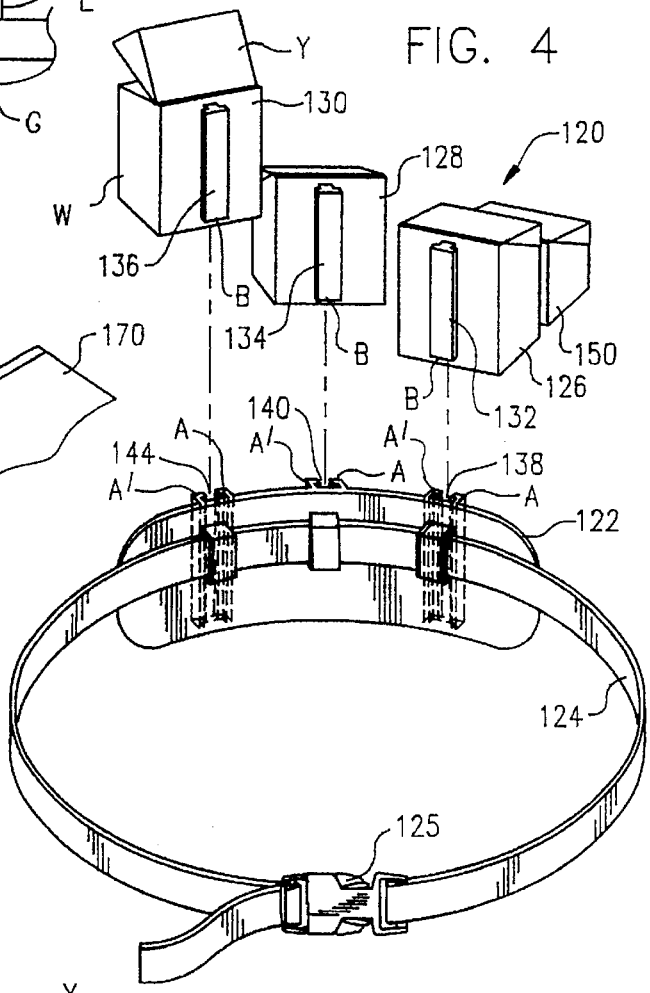
FIG. 4 illustrates the modular interlocking container system of the present invention used in a small, waist fastened pack system.

FIG. 4 illustrates a further embodiment of my modular pack system. A pack system 120 is provided with a substantially flexible base 122 which is adjustably (preferably slideably) fastened to a belt 124. Thus, the belt 124 is used to fasten (such as by fastener 125) the base 122 and selected containers 126, 128, and 130 to personnel (not shown) who are using the pack system 120. Just as illustrated above, containers 126, 128, and 130 are provided with detachably engaging means such T-shaped brackets 132, 124, and 136 which are complementary to female engaging means, specifically T-shaped slot members 138, 140, and 144, which are located on base 122.

Figure 5:
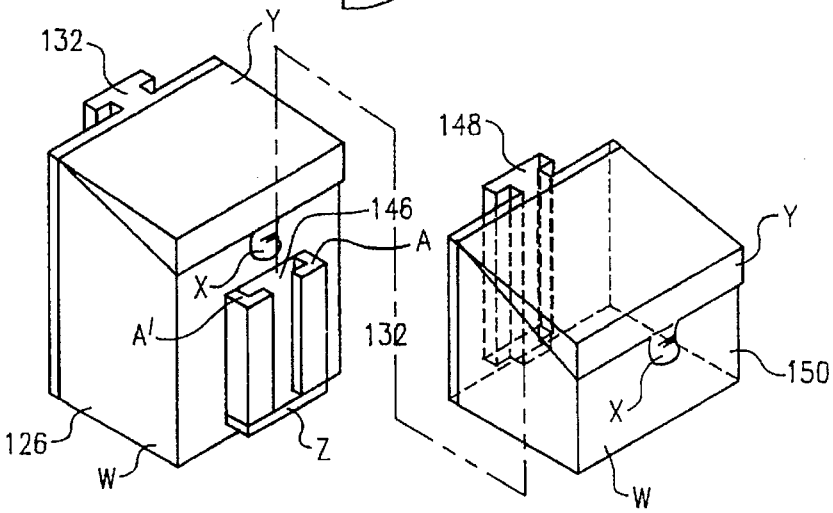
FIG. 5 illustrates a set of interlocking containers utilized in the piggyback configuration.

As indicated in FIG. 5, the containers 126, 128, and 130 can also be provided with a piggyback engagement system, including a further T-shaped slot 146 and complementary T-shaped bracket 148 on an additional container 150. This piggyback system, when applied to a "belly band" or "waist pack" type system, provides a heretofore unavailable expansion means to dramatically increase the amount of goods that can be carried by personnel wearing such devices.

Figure 6:
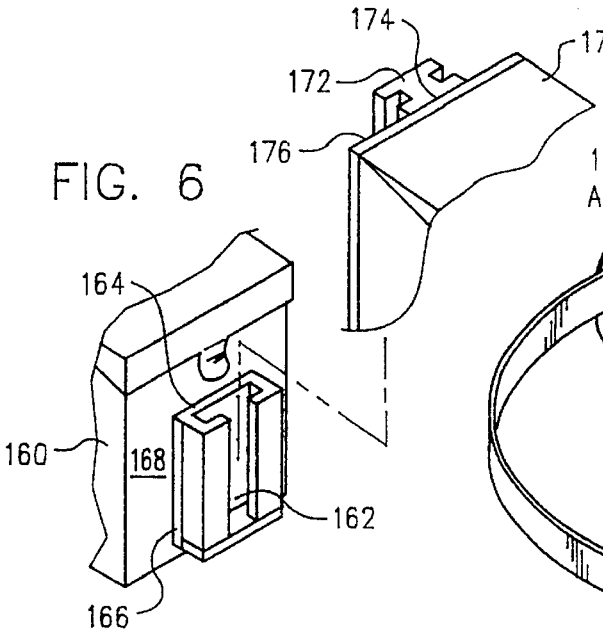
FIG. 6 illustrates a set of interlocking containers wherein the interlocking members are affixed to the containers, rather than being integrally formed with the containers.

Attention is now directed to FIG. 6, wherein interlocking container 160 is provided with an add-on type T-shaped slot 162, rather than an integrally formed slot as set forth in the various figures above. Slot 162 has a rear portion 164 which has a rear side (hidden, but the left side 166 of the rear side is noted) which may be affixed, such as by adhesive bonding, to the side 168 of container 160. Container 170 has a complementary T-shaped bracket 172 for interfitting with and interlocking to the T-shaped slot 162. The T-shaped bracket 172 may also be provided in an add-on type configuration, rather than in an integrally formed configuration. As illustrated, bracket 172 has a back portion 174 which may be affixed to the front 176 of container 170 by any convenient means, such as with fasteners or by adhesive bonding.

Figure 7:
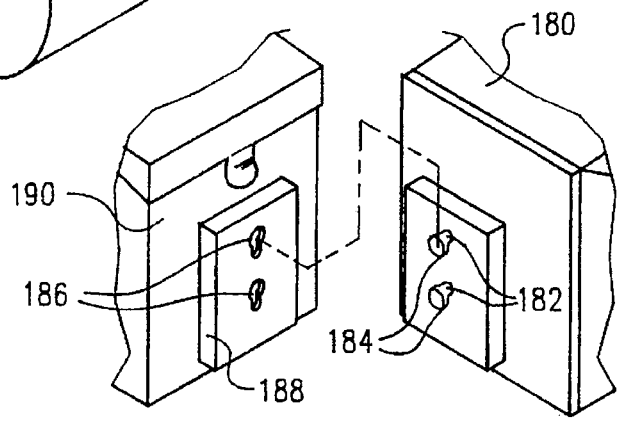
FIG. 7 illustrates an alternative embodiment of my interlocking pack members, showing an eccentric locking post and slot type locking system.

In FIG. 7, an alternative embodiment of my interlocking hard-pack system is illustrated, showing container 180 with two eccentric male post members 182 each having locking flange 184 portions. The eccentric post members 182 are adapted to fit into and slidingly engage and interlock with female slot members 186 in the locking plate 188 which is affixed to container 190.

Of course, those skilled in the art will appreciate that various modifications can be made to the exemplary modular hard-pack system and apparatus without departing from the spirit and scope of the invention as described herein. The reader can readily appreciate that it makes no difference which of the complementary brackets is mounted on the frame and which is mounted on the container, and to reverse the location of the male and female portions of the engagement means described herein accomplishes the same result. Also, the reader can appreciate that the male "T" engagement means and complementary female engagement means could just as easily be provided in a circular or elliptical shape, rather than of the linear construction illustrated, and still fall within the general description provided.

Therefore, it will be understood that the foregoing description of representative embodiments of the invention have been presented only for purposes of illustration and description and for providing an understanding of the invention. It is not intended to be exhaustive or to limit the invention to the precise forms disclosed. On the contrary, the intention is to cover all modifications, equivalents, and alternatives falling within the spirit and scope of the invention as expressed in the appended claims. It is therefore intended that the scope of the invention be defined by the appended claims rather than by the foregoing description; and all changes which come within the meaning and range of equivalency of the claims are therefore intended to be embraced therein.

I claim:

1. An apparatus for storage and transport of goods, said apparatus, comprising:

(a) a first container for holding goods, said container further comprising front, back, and bottom surfaces and a first cooperating engagement means, said first cooperating engagement means being integrally formed with said container, said first cooperating engagement means having a bottom portion;

(b) a base, said base further comprising a second cooperating engagement means integrally and seamlessly formed with said base and shaped to provide complementary meshing engagement of said second cooperating engagement means with said first cooperating engagement means when said first and said second cooperating engagement means are brought together to detachably connect said first container to said base, said second engagement means having a bottom portion;

(c) wherein at least one of said first and said second cooperating engagement means further comprises a stop, wherein said stop cooperates with said bottom portion of the engagement means complimentary thereto, so as to limit the downward travel of said first container relative to said base when said base is in a substantially vertical position;

(d) a second container, said second container including a third cooperating engagement means, and wherein said first container further includes a fourth cooperating engagement means for cooperating with said third engagement means to affix said second container to said first container;

(e) wherein said fourth cooperative engagement means on said first container is mounted substantially horizontally on said bottom surface of said first container, so that said third engagement means on said second container can detachably affix said second container to the bottom surface of said first container;

(f) wherein said second container comprises an expansible tubular member, and wherein said substantially cylindrical tubular member is adapted to carry a sleeping bag.

2. A backpack for storage and transport of goods, said backpack primarily for use in a substantially vertical position by a person standing or walking erect, said backpack comprising:

(a) a first container for holding goods, said container further comprising front, back, and bottom surfaces and a first cooperating engagement means, said first cooperating engagement means integrally formed with said container and forming a part thereof, said first cooperating engagement means having a bottom portion;

(b) a base, said base further comprising a second cooperating engagement means integrally and seamlessly formed with said base and shaped to provide complementary meshing engagement of said second cooperating engagement means with said first cooperating engagement means when said first and said second cooperating engagement means are brought together to detachably connect said first container to said base, said second engagement means having a bottom portion;

(c) wherein at least one of said first and said second cooperating engagement means further comprises a stop, wherein said stop cooperates with said bottom portion of the engagement means complimentary thereto, so as to limit the downward travel of said first container relative to said base when said base is in a substantially vertical position;

(d) a second container, said second container including a third cooperating engagement means, and wherein said first container further includes a fourth cooperating engagement means for cooperating with said third engagement means to affix said second container to said first container;

(e) a third container, said third container including a fifth cooperating engagement means, and wherein said first container further includes a sixth cooperating engagement means for cooperating with said fifth engagement means to affix said third container to said first container;

(f) wherein said fourth cooperative engagement means on said first container is mounted substantially horizontally on said bottom surface of said first container, so that said third engagement means on said second container detachably affixes said second container to the bottom surface of said first container;

(g) wherein said second container comprises an expansible tubular member; and (h) wherein said second container is adapted to carry a sleeping bag.

* * * * *